US007295090B2

(12) United States Patent
Kayano et al.

(10) Patent No.: US 7,295,090 B2
(45) Date of Patent: Nov. 13, 2007

(54) FILTER CIRCUIT

(75) Inventors: Hiroyuki Kayano, Fujisawa (JP); Tatsunori Hashimoto, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 146 days.

(21) Appl. No.: 11/167,172

(22) Filed: Jun. 28, 2005

(65) Prior Publication Data

US 2005/0285701 A1 Dec. 29, 2005

(30) Foreign Application Priority Data

Jun. 28, 2004 (JP) ..... 2004-190059

(51) Int. Cl.
*H01P 1/20* (2006.01)

(52) U.S. Cl. ..... 333/202; 333/126; 333/204

(58) Field of Classification Search ..... 333/168, 333/175, 202, 204, 126, 134, 132
See application file for complete search history.

(56) References Cited

U.S. PATENT DOCUMENTS 5,184,096 A * 2/1993 Wakino et al. ..... 333/175
6,107,898 A * 8/2000 Rauscher ..... 333/175
6,518,854 B2 2/2003 Kayano et al.
6,759,930 B2 7/2004 Kayano et al.
7,171,235 B2 * 1/2007 Haapoja ..... 455/553.1
2002/0186092 A1 * 12/2002 Kayano et al. ..... 333/99 S
2004/0041635 A1 3/2004 Sano et al.

FOREIGN PATENT DOCUMENTS

JP 2000-114807 4/2000
JP 2001-345601 12/2001

OTHER PUBLICATIONS

Takayuki Kato, et al., "Studies on the Equivalent Circuits of Dual-Mode Rectangular Waveguide Filters Using HFSS and MDS", Technical Report of IEICE, MW 98-85, Sep. 1998, pp. 73-80.
U.S. Appl. No. 11/534,069, filed Sep. 21, 2006, Kayano.
U.S. Appl. No. 11/534,368, filed Sep. 22, 2006, Kayano.
U.S. Appl. No. 11/477,435, filed Jun. 30, 2006, Kayano.

* cited by examiner

*Primary Examiner*—Seungsook Ham
(74) *Attorney, Agent, or Firm*—Oblon, Spivak, McClelland, Maier & Neustadt, P.C.

(57) ABSTRACT

A filter circuit includes a plurality of resonators connected in parallel and each having loaded Q deviation equal to allowable deviation of a group delay, a divider to divide an input signal to the resonators, a combiner to combine output signals of the resonators, and an opposite phase unit for making signals passing two resonators of the resonators an approximately opposite phase in an output of the combiner, the two resonators having resonance frequencies adjacent to each other, respectively.

17 Claims, 8 Drawing Sheets

FILTER CIRCUIT

CROSS-REFERENCE TO RELATED APPLICATIONS

This application is based upon and claims the benefit of priority from prior Japanese Patent Application No. 2004-190059, filed Jun. 28, 2004, the entire contents of which are incorporated herein by reference.

BACKGROUND OF THE INVENTION

1. Field of the Invention

The present invention relates to a filter circuit suitable for a band-pass filter arranged on a rear stage of a power amplifier in a transmitter of a radio communication apparatus.

2. Description of the Related Art

In a transmitter of a radio communication apparatus, a band-pass filter is arranged on a rear stage of a power amplifier which amplifies a high frequency signal to supply a transmission power to a radio antenna. Such a filter is realized generally by connecting a plurality of resonators in cascade. In this case, if input and output coupling coefficients of a resonator and a value of an external Q are properly determined, it is possible to determine a passage frequency range of the filter and a blocking domain attenuation quantity thereof.

The power of a signal input to the filter passes all resonators connected in cascade with approximately the same electric energy. Energy (power) stored in each resonator depends upon input and output coupling coefficients of the resonator. The input coupling coefficient is a coupling coefficient between the input terminal of the resonator and an input circuit, and the output coefficient is a coupling coefficient between the output terminal of the resonator and an output circuit. Generally, the power to be stored in the resonator concentrates on the resonator that the input and output coupling coefficients are small. A problem for power concentration is that concentration of electric fields on a metallic edge heats the metal due to the resistance thereof, resulting in burning dielectrics used for decreasing the size of the filter. Because it is difficult in design to change the resonator according to electric field concentration, and to exchange a resonator, a filter is made using a resonator of high allowable over-power.

Consequently, for the purpose of realizing a desired filter property by distributing a signal power passing the filter, a method of fabricating a filter by connecting a plurality of resonators in parallel is provided by Japanese Patent Laid-Open No. 2001-345601. This filter divides the power to plural resonators. Also, this filter increases a group delay on both ends of a required bandwidth similarly to a cascade-connected resonator type of filter. The parallel connection of the plural resonators divides an input signal power into the resonators, resulting in improving power-resistance property of the filter. In this case, the resonators have different resonance frequencies, and are arranged so that signals passing the resonators having adjacent resonance frequencies are in opposite phase to each other. As a result, a desired filter property can be realized.

The filter fabricated by connecting a plurality of resonators in parallel is designed so as to be equivalent to a filter fabricated by a plurality of resonators connected in cascade as described in Kato, Yamanaka, Ma, and Kobayashi, "Study of an equivalent circuit of double mode rectangular waveguide filter using HFSS and MDS" Singaku Jihou, MW 98-85, pp. 73-80, September 1998. This filter realizes a desired filter property by changing input and an output coupling coefficients between resonators. For this reason, the power distribution cannot uniformly done.

A modulation system used for radio communication in recent years is an angle modulation system such as QPSK (Quadrature Phase Shift Keying) and QAM (Quadrature Amplitude Modulation), and signal components are included in phase information. Therefore, a band-pass filter provided in a transmitter can uniformly divide a power to resonators to flat a group delay characteristic caused by phase distortion.

It is an object of the present invention to provide a filter circuit capable of performing uniformly power dispersion to a plurality of resonators connected in parallel and realizing flat group delay characteristic, and a radio communication apparatus using the same.

BRIEF SUMMARY OF THE INVENTION

An aspect of the invention provides a filter circuit comprising a plurality of resonators connected in parallel and each having loaded Q deviation equal to allowable deviation of a group delay; a divider to divide an input signal to the resonators; and a combiner to combine output signals of the resonators, two resonators of the resonators having resonance frequencies adjacent to each other, the two resonators being arranged to make signals passing the two resonators an approximately opposite phase in an output of the mixer.

Another aspect of the invention provides a filter circuit comprising: a plurality of resonators connected in parallel and having loaded Q deviation equal to allowable deviation of a group delay; a divider to divide an input signal to the resonators; a combiner to combine output signals of the resonators; and a delay circuit provided between at least one of the resonators and the combiner to make signals passing two resonators of the resonators an approximately opposite phase in an output of the combiner, the two resonators having two adjacent resonance frequencies, respectively.

Another aspect of the invention provides a filter circuit comprising: a plurality of resonators connected in parallel and having loaded Q deviation equal to allowable deviation of a group delay; a divider to divide an input signal to the resonators; a combiner to combine output signals of the resonators; and a delay circuit provided between the divider and at least one of the resonators to make signals passing two resonators of the resonators an approximately opposite phase in an output of the combiner, the two resonators having two adjacent resonance frequencies respectively.

DETAILED DESCRIPTION OF THE INVENTION

FIRST EMBODIMENT

Figure 1:
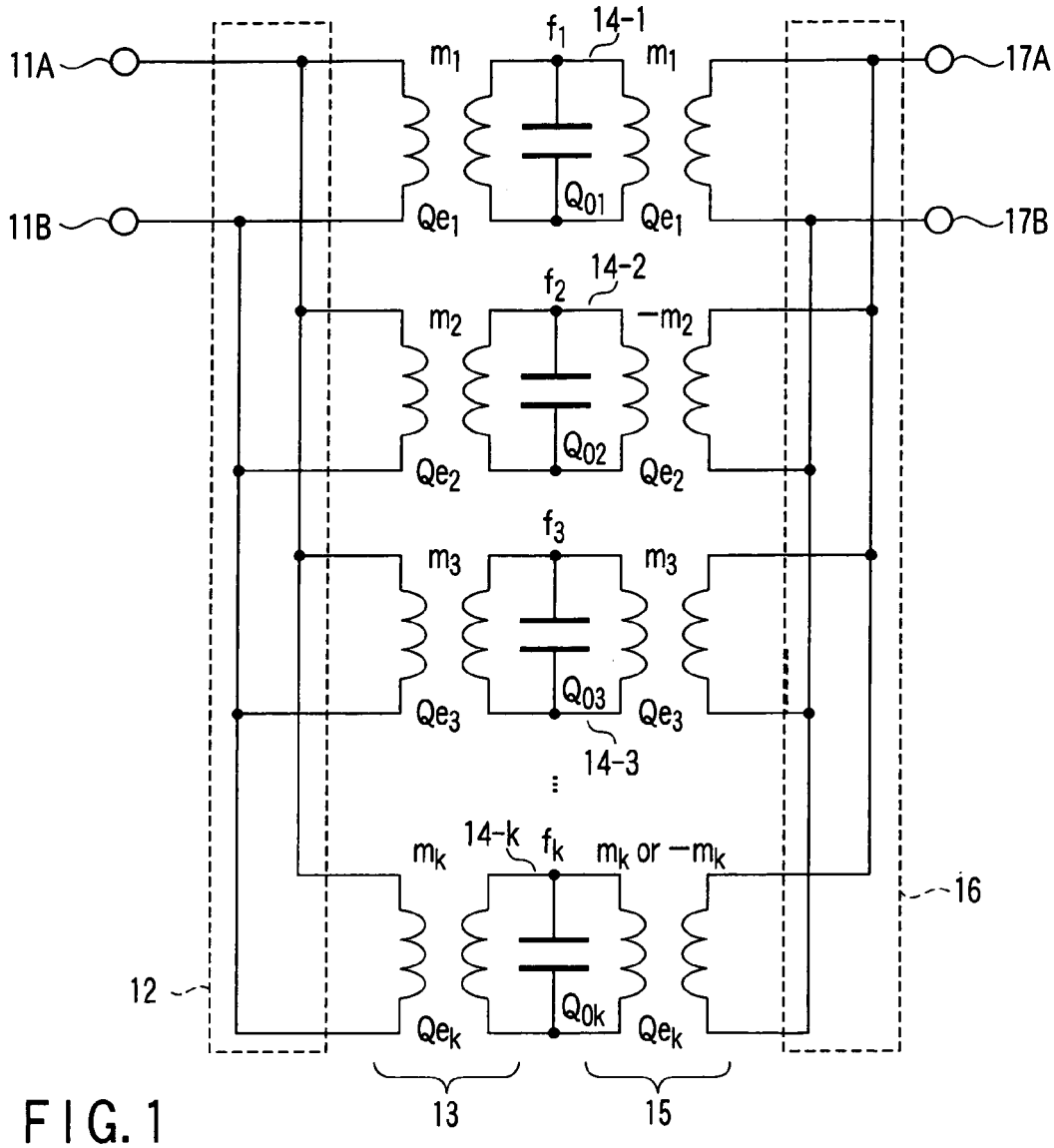
FIG. 1 is an equivalent circuit schematic of a filter circuit concerning the first embodiment of the present invention.

As shown in FIG. 1, in the filter circuit concerning the first embodiment of the present invention, the input terminal of an power divider 12 is connected to signal input terminals 11A and 11B. The output terminal of the power divider 12 is connected to the input terminals of k resonators 14-1 to **14-*k* (k is an integer more than 4) through an input coupler 13. The output terminals of the resonators 14-1 to 14-*k* are connected to the input terminals of a power combiner 16 through an output coupler 15. The output terminals of the power combiner 16 are connected to signal output terminals 17A and 17B. A high frequency transmission signal from the power amplifier (not shown), for example, is input to the signal input terminals 11A and 11B. A transmission signal output from the signal output terminals 17A and 17**B is subjected to band limiting and supplied to an antenna (not shown), for example.

Figure 2:
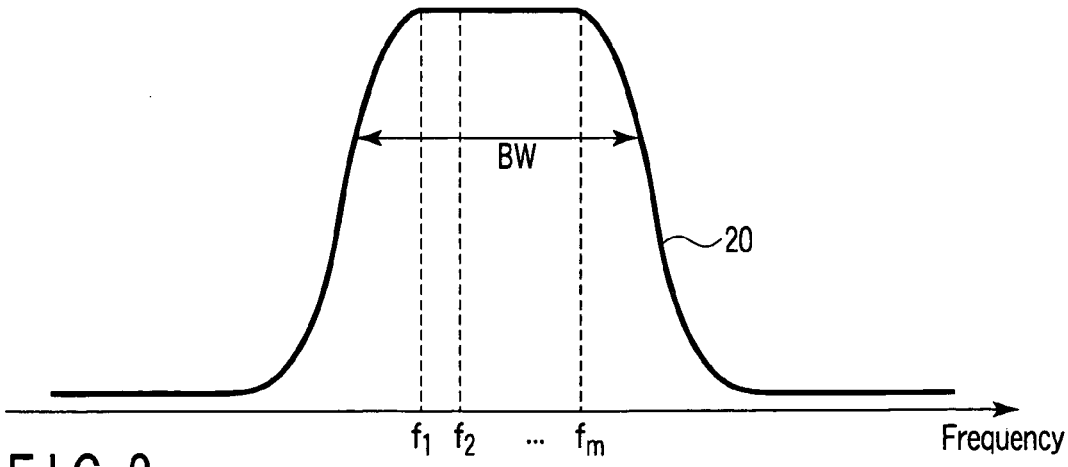
FIG. 2 is a diagram showing an example of a frequency transmission response property of the filter circuit.

FIG. 2 shows a frequency transmission response 20 required by the filter circuit. The resonators 14-1 to **14-*k* have different resonance frequencies f1, f2, . . . , fk, respectively, as shown in FIG. 2. A difference Δfi=fi+1−fi between adjacent resonance frequencies of the resonators 14-1 to 14-*k*** (i is a natural number not more than k-1) is set to satisfy the following condition with the assumption that the bandwidth (3 dB) of the band-pass of the filter is BW.

$$\Delta fi \leqq 2*BW/(k-1) \quad (1)$$

If loaded Qs of all resonators 14-1 to **14-*k* are basically equal, the resonance frequency difference Δfi is set so that the resonance frequencies of the resonators 14-1 to 14-*k*** are arranged at even intervals in the bandwidth BW. However, if the loaded Q has deviation as shown in this embodiment, a desired filter property can be realized by satisfying a condition of the equation (1) as a condition by which the resonance frequency is not replaced.

The filter circuit of FIG. 1 is configured so that the signal passing the resonator (assuming **14-*i*) of resonance frequency fi and a signal (assuming 14-*i*+1) passing the resonator of resonance frequency fi+1 are in approximately opposite phase to each other in the output signal of the power combiner 16. Such a phase relationship can be realized by configuration of the input coupler 13 or output coupler 14 for realizing the external Q: QEXT, the power divider 12 or the power combiner 16**.

On the other hand, assuming that no-loaded Q of the resonators 14-1 to **14-*k*** is QU, the external Q is QEXT, and loaded Q is QL, QL is determined by the following equation.

$$(1/Q_{Lj})=(1/Q_{Uj})+(2/Q_{EXTj}) \quad (2)$$

where, j is a natural number not more than k.

As already known, no-loaded Q of the resonator is Q when the resonator is no load, the external Q is Q of the load watched from the input and output terminals of the resonator, and loaded Q is Q when load is connected to the resonator. In the filter circuit of FIG. 1, the external Q is determined by the input coupler 13 and output coupler 15.

The loaded Q means the number of times by which a signal energy in a resonance frequency is repeated in the resonators 14-1 to **14-*k*, and is proportional to the time interval during which the signal passes the resonator 14 substantially. Accordingly, it is possible to equalize stored energies of the filter circuit by matching the values of the loads Q: QL of the resonators 14-1 to 14-*k*** to each other with a small difference. At the same time, it is possible to flat a group delay frequency characteristic.

In other words, the group delay frequency characteristic which has allowable deviation and is more flat can be realized by equalizing deviation between loads Q of the resonators 14-1 to **14-*k* to allowable deviation of a group delay of the filter circuit (allowable delay time difference between the resonators 14-1 to 14-*k***)1. When the relation between the maximum group delay τ [sec] and the loaded Q; QL is most simplified, the following equation (3) is provided.

$$\tau=N\times QL/f \quad (3)$$

where f is the resonance frequency [Hz] of a resonator, and N represents the length of a resonator with a wavelength. For example, a quarter-wavelength resonators is N=¼, a half-wavelength resonator is N=½, and one wavelength resonator is N=1. Accordingly, the allowable deviation of the loaded Q; QL is equal to the allowable deviation of the group delay. The allowable deviation of the group delay of the filter circuit is different due to specification, but generally within ±20% of τ, preferably within ±10% of τ. When such a specification is given, the allowable deviation of QL also is within ±20% of τ, preferably ±10% of τ.

Figure 3:
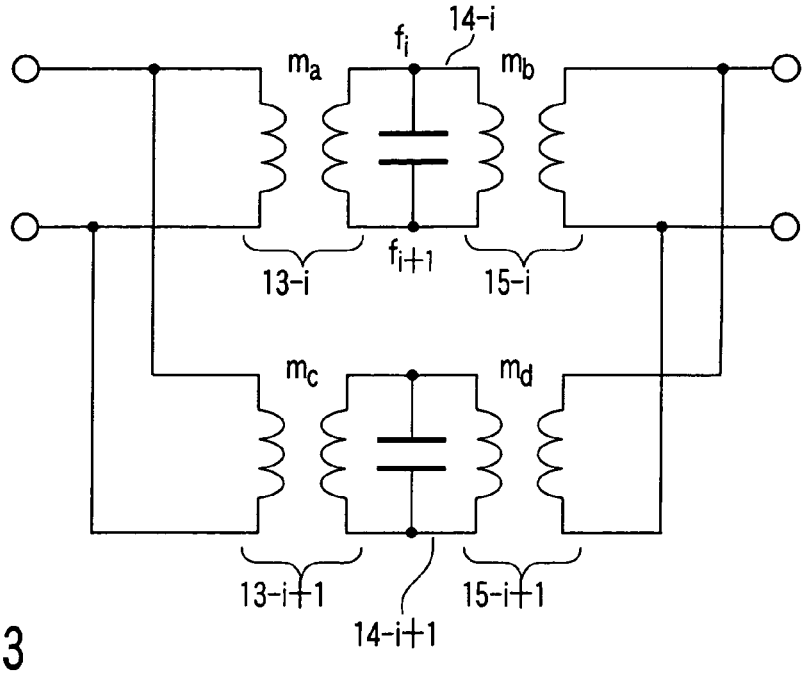
FIG. 3 is a diagram for explaining a principle of the first embodiment.

The principle of operation of the filter circuit of FIG. 1 is described in conjunction with FIG. 3 hereinafter. FIG. 3 shows the resonators **14-*i* and 14-*i*+1 having two adjacent resonance frequencies fi and fi+1, respectively, the input couplers 13-*i* and 13-*i*+1 connected to the resonators 14-*i* and 14-*i*+1, and the output couplers 15-*i* and 15-*i*+1. Assuming that the coupling coefficient of the input coupler 13-*i* (coupling coefficient between the power divider 12 and the resonator 14-*i*) is ma, the coupling coefficient of the output coupler 15-*i* (coupling coefficient between the resonator 14-*i* and the power combiner 16) is mb, the coupling coefficient of the input coupler 13-*i* (coupling coefficient between the power divider 12 and the resonator 14-*i*+1) is mc, and the coupling coefficient of the output coupler 15-*i*+1 (coupling coefficient between the resonator 14-*i*+1 and the power combiner 16**) is md.

In this case, the signal passing the resonator **14-*i* and the signal passing the resonator 14-*i*+1 are in approximately opposite phase to each other in an output signal of the power combiner 16 by reversing the polarity of either one of coupling coefficients ma, mb, mc and md with respect to the other polarity. In the example of FIG. 1, ma=m1, mb=m1, mc=m2, md=−m2**. In other words, one of the coupling coefficients ma, mb, mc and md is assumed a negative polarity, and all of others are assumed a positive polarity. One of the coupling coefficients ma, mb, mc and md may be assumed a positive polarity, and others may be assumed a negative polarity in others. The plus and minus of the coupling coefficient means plus and minus of the phase, and may be represented as capacitive coupling and inductive coupling.

Figure 4:
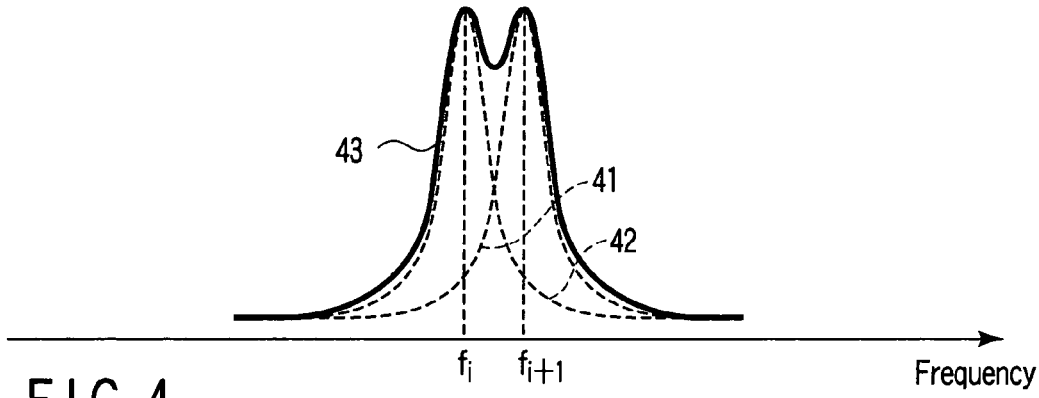
FIG. 4 is a diagram showing a frequency characteristic of two resonators shown in FIG. 3 and a frequency transmission response property of the filter circuit.

In the example of FIG. 1, the polarity of the coupling coefficient between the resonators 14-*i* and the power combiner 16 and the polarity of the coupling coefficient between the resonator 14-*i*+1 and the power combiner 16 are different. However, even if the polarity of the coupling coefficient between the power divider 13 and the resonator 14-*i* and that between the power divider 13 and the resonator 14-*i*+1 are different, the similar result can be obtained. The relation of magnitudes of the coupling coefficients ma, mb, mc and md is described as |ma|=|mb|, |mc|=|md|. However, the relation is not limited to this. In the case that, in this way, one of the coupling coefficients ma, mb, mc and md is assumed the first polarity and others is assumed the second polarity opposite to the first polarity, when the resonators 14-*i* and 14-*i*+1 have unit frequency transmission responses 41 and 42 as shown in FIG. 4, a frequency transmission response 43 of the sum of the unit frequency transmission responses 41 and 42 is provided for the whole filter circuit from the signal input terminals 11A and 11B to the signal output terminal 17A ands 17B. A ripple is appeared in the frequency transmission response 43 between the resonance frequencies fi and fi+1, but, this ripple can be adjusted to the ripple quantity demanded by the output waveform of the filter circuit by setting the interval between the frequencies fi and fi+1 and the magnitudes of the coupling coefficients ma, mb, mc and md to adequate values, to provide a good frequency characteristic.

Figure 5:
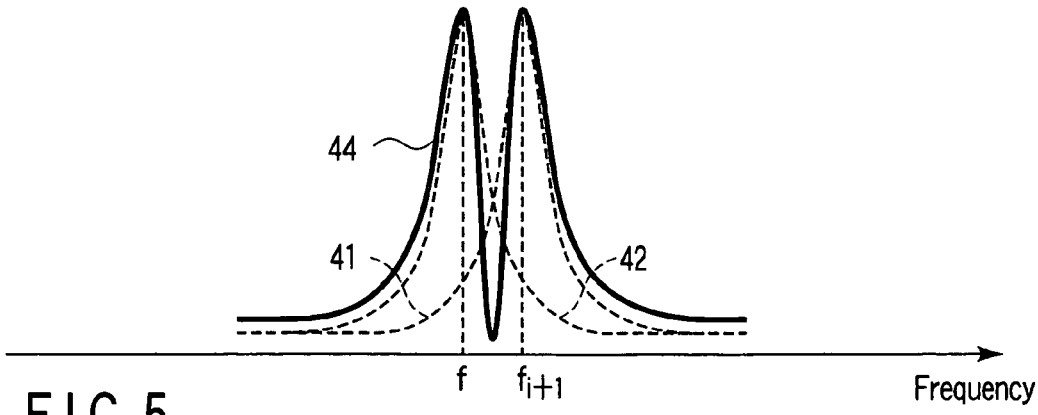
FIG. 5 is a diagram showing a frequency characteristic of two conventional resonators and a frequency transmission response property of a conventional filter circuit.

FIG. 5 shows a characteristic when the polarities of the coupling coefficients ma, mb, mc and md are the same, for example, positive polarity. In this case, the frequency transmission response 44 of the whole filter circuit is a response synthesized as a difference between the unit frequency transmission responses 41 and 42 of the resonators 14-*i* and 14-*i*+1. Since, in this frequency transmission response 44, a very large ripple exists between the resonance frequencies fi and fi+1, even if the interval between the resonance frequencies fi and fi+1 and the magnitudes of the coupling coefficients ma, mb, mc and md are adjusted, the flat frequency characteristic cannot be provided. According to one embodiment of the present invention, the ripple quantity can be decreased as shown in FIG. 4, so that more flat frequency characteristic can be realized.

In the filter circuit concerning one embodiment of the present invention, it is possible to avoid extreme power concentration to a resonator and flat a group delay frequency characteristic by decreasing the loaded Q deviation of the resonators 14-1 to 14-*k*, and distributing a transmission signal power to the resonators 14-1 to 14-*k* equally. Accordingly, even in a radio communication apparatus using the modulation system having a signal component in phase information such as QPSK and QAM, it is possible to avoid signal degradation due to phase distortion in a group delay frequency characteristic.

SECOND EMBODIMENT

The second embodiment of the present invention will be described. The first embodiment provides a method of reversing the polarity of one of the coupling coefficients ma, mb, mc and md with respect to the remaining coupling coefficients by an input coupling circuit and an output coupling circuit so that the signals passing the resonators 14-*i* and 14-*i*+1 of adjacent resonance frequencies fi and fi+1, respectively, are substantially in opposite phase in the output signal of the power combiner 16. The second embodiment provides a method of making the signals passing the resonators opposite phase using delay circuits.

Figure 6:
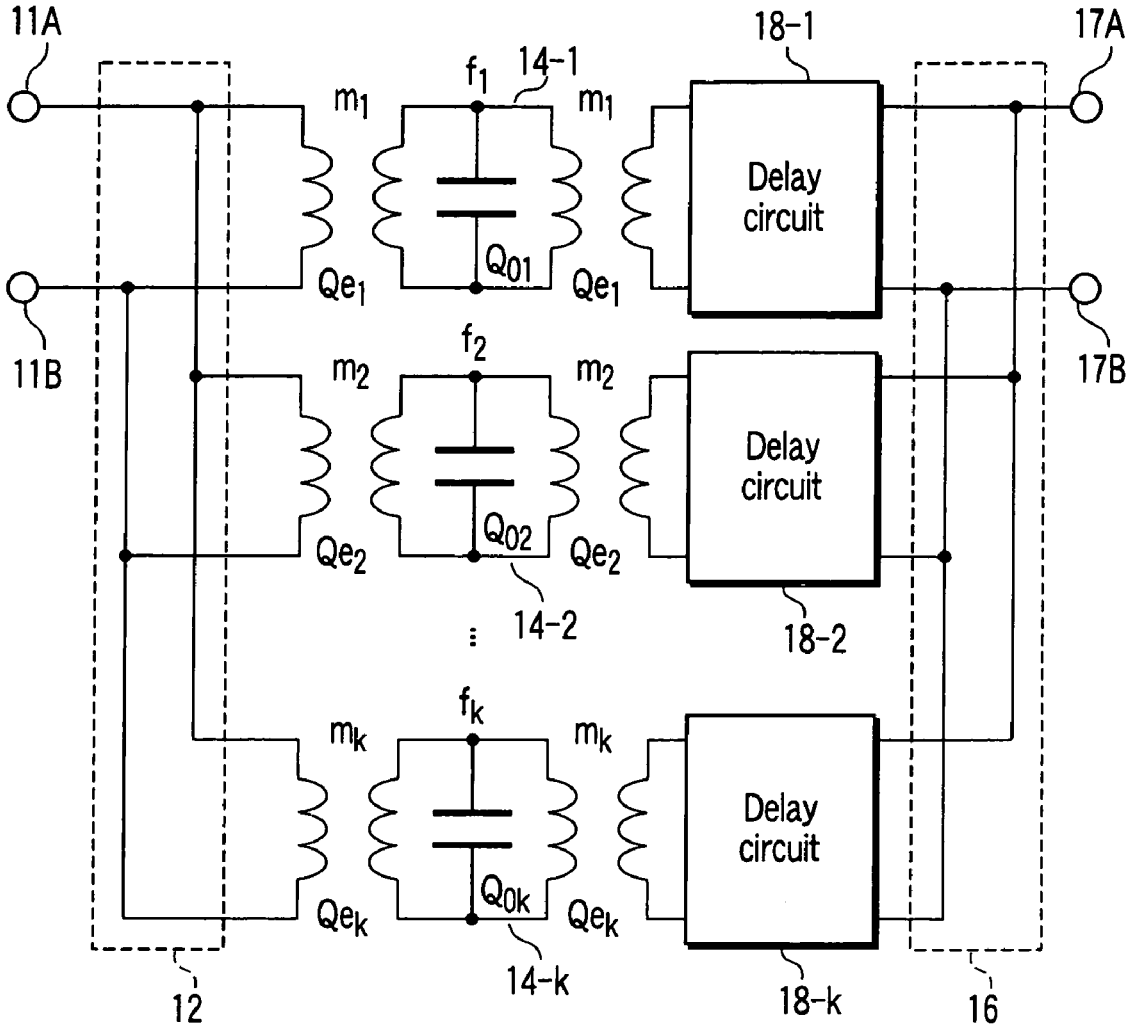
FIG. 6 is an equivalent circuit diagram of a filter circuit concerning the second embodiment of the present invention.

In other words, in the second embodiment, output delay circuits 18-1 to 18-*k* are interposed between the resonators 14-1 to 14-*k* and the power combiner 16 as shown in FIG. 6, for example. The delay times of the output delay circuits 18-1 to 18-*k* are set at the values that signals passing the resonators 14-*i* and 14-*i*+1 of adjacent resonance frequencies fi and fi+1 come to opposite phase to each other. The signals passing the resonators 14-*i* and 14-*i*+1 need not always to come to completely opposite phase to each other. The delay times of the delay circuits are set at the values that the signals passing the resonators 14-*i* and 14-*i*+1 have a phase difference in a range of, for example, (180°±30°)+360°×n (n is a natural number).

In this case, the frequency transmission response of the filter circuit from the signal input terminals 11A of 11B to the signal output terminals 17A to 17B comes to a frequency transmission response 43 shown in FIG. 4 similarly to the first embodiment. In this time, the polarities of the coupling coefficients ma, mb, mc and md all may be positive or negative as explained in FIG. 3. Since the resonators all are in phase but not in opposite phase, a coupler can be realized in a divided constant circuit and a lumped parameter circuit aside from a solid circuit. The present embodiment provides a circuit configuration effective for a case using a circuit difficult to realize a different phase relation of positive and negative phases such as a case realizing a filter circuit by filter coupling using a plane circuit.

The output delay circuits 18-1 to 18-*k* are interposed between the resonators 14-1 to 14-*k* and the power combiner 16 in FIG. 6. However, the input delay circuits 19-1 to 19-*k* may be interposed between the power divider 12 and the resonators 14-1 to 14-*k* as shown in FIG. 7.

Figure 7:
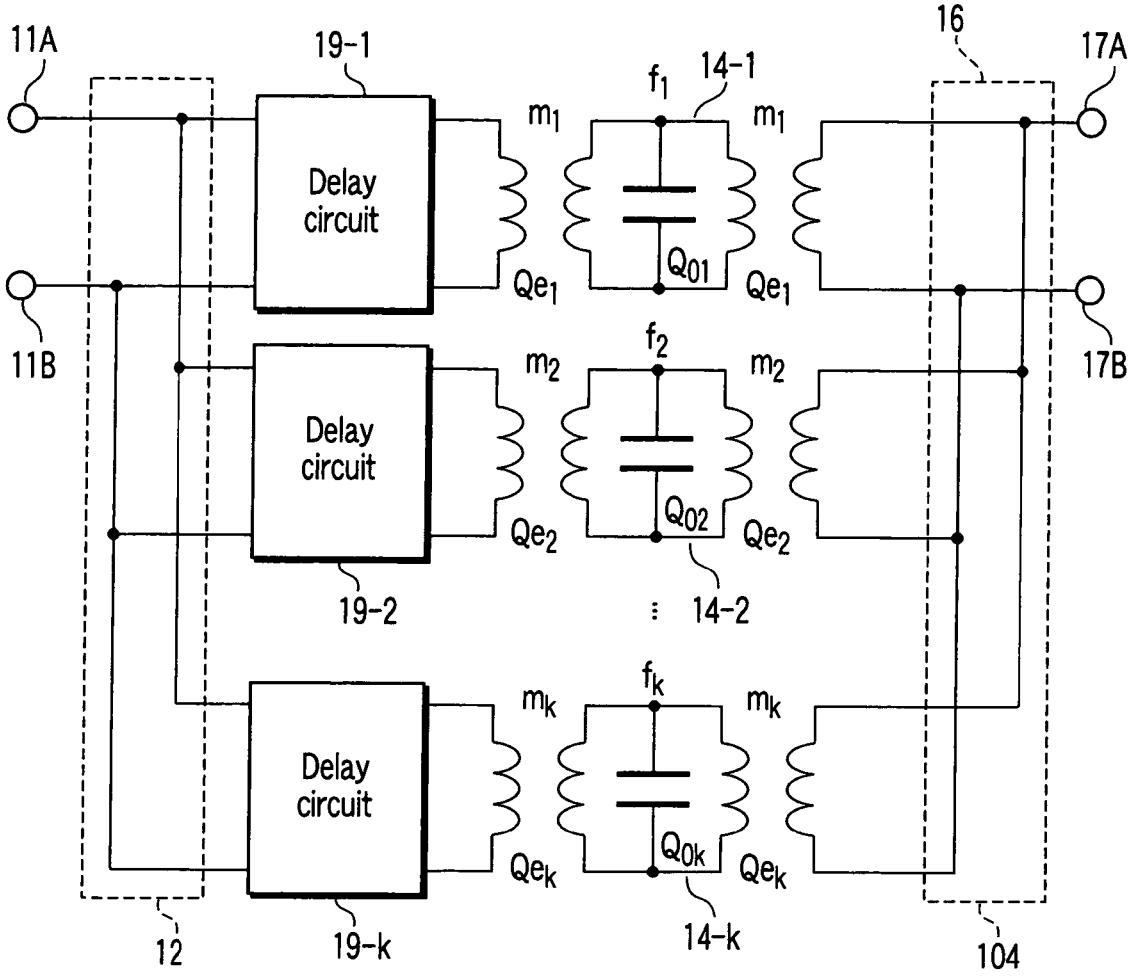
FIG. 7 is an equivalent circuit diagram of modification of the filter circuit concerning the second embodiment of the present invention.

It is not always needed to interpose delay circuits between the power combiner 16 and all resonators 14-1 to 14-*k* as shown in FIG. 6 or between the power divider 12 and all resonators 14-1 to 14-*k* as shown in FIG. 7, and one of the delay circuits, for example, delay circuit 18-2 or 19-2 may be omitted.

A configuration to interpose a delay circuit between one of the resonators 14-1 to 14-*k* and the power combiner 16, and interpose a delay circuit between the power divider 12 and one of the resonators 14-1 to 14-*k* is available.

In brief, it is an object of the second embodiment to interpose delay circuits between the resonators 14-1 to 14-*k* and the power combiner 16 or between the power divider 12 and the resonators 14-1 to 14-*k* so that the signals passing the resonators 14-*i* and 14-*i*+1 of adjacent resonance frequencies fi and fi+1 have an approximately opposite phase relation, for example, a phase difference within a range of (180°±30°)+360°×n (n is a natural number).

In the second embodiment, it is similar to the first embodiment that the resonance frequencies f1, f2, . . . , fk of the resonators 14-1 to 14-*k* satisfy the relation of the equation (1), and the loaded Q; QL has deviation equal to allowable deviation of the group delay of the filter circuit, for example, deviation within ±20% of τ, preferably ±10% of τ.

In the second embodiment, the pass band and out-of-band attenuation magnitude of the frequency transmission response 20 of filter circuit that is shown in FIG. 2 are realized by adequately selecting the coupling coefficients (coupling coefficients ma, mb, mc and md which are explained in FIG. 3) of the input coupler 13 and output coupler 15.

Some concrete examples realizing the filter circuit concerning the second embodiment using a real circuit element will be described referring to FIGS. 8A to 12.

FIRST CONCRETE EXAMPLE

Figure 8A:
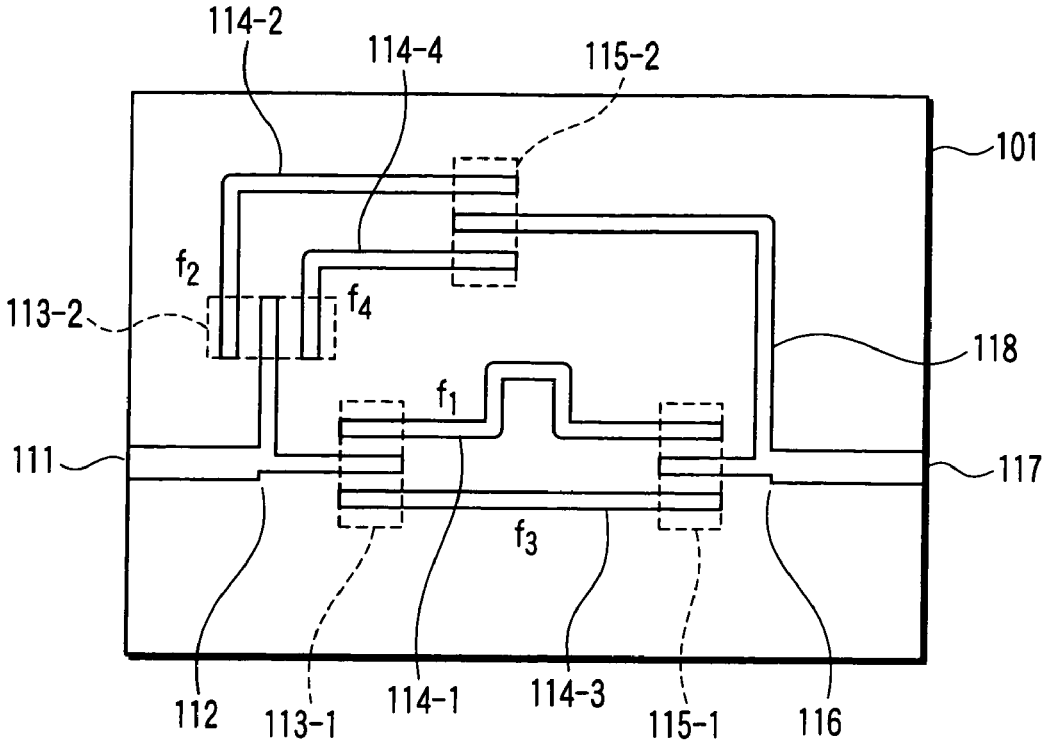
FIGS. 8A and 8B show top and bottom plan views of a first concrete unit of the filter circuit concerning the second embodiment, respectively.
Figure 8B:
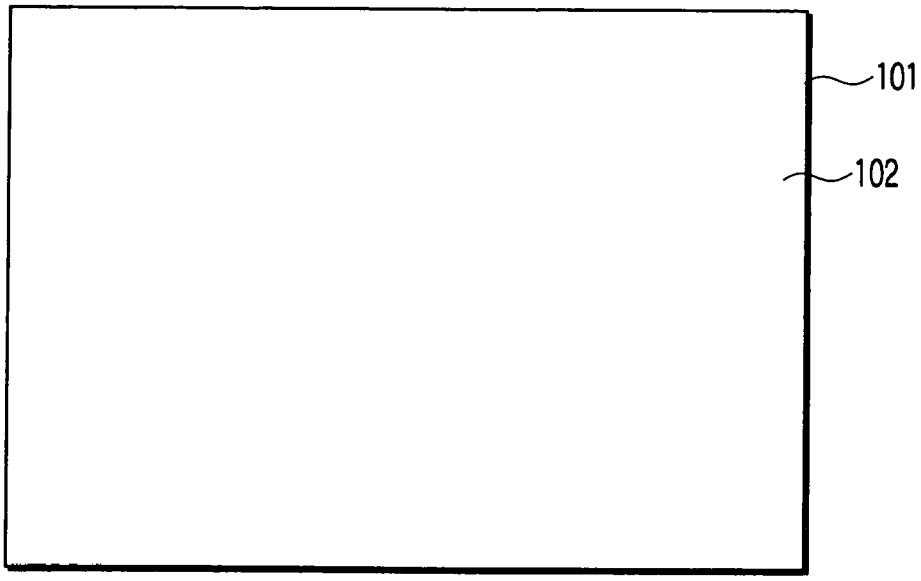

The filter circuit concerning the first concrete example shown in FIGS. 8A and 8B is realized by forming a microstrip line on a dielectric substrate 101, on the rear face of which a grounding conductor film 102 is adhered. On the main surface of the dielectric substrate 101 are provided a signal input terminal 111, an power divider 112, input couplers 113-1, 113-2, resonators 114-1 to 114-4 each comprising a half-wavelength type resonator, output couplers 115-1, 115-2, a power combiner 116, a signal output terminal 117 and an output delay circuit 118. FIGS. 8A and 8B show one signal input terminal 111 and one signal output terminal 117. The other signal input terminal and signal output terminal which are not shown are connected to the grounding conductor film 102.

The resonators 114-1 to 114-4 comprise microstrip lines having lengths of half-wavelength in resonance frequencies f1, f2, f3 and f4, respectively. These microstrip lines perform excitation and detection. The input couplers 113-1 and 113-2 and output couplers 115-1 and 115-2 are realized by coupling between the microstrips.

The power divider 112 and power combiner 116 are configured by branches of the microstrip line. The impedance matching in the power divider 112 and power combiner 116 is realized by changing the width of the microstrip line in front and back of each of the power divider 112 and power combiner 116.

Because, in the resonators using the microstrip line, unloaded Q are approximately same, it is necessary for decreasing deviation of the loaded Qs, preferably for equalizing values of the loaded Qs to equalize the input and output coupling coefficients of each of the resonators, thereby equalizing external Qs. In order to realize this, the input couplers 113-1, 113-2 and output couplers 115-1, 115-2 are configured to have the same layout to equalize the external Qs of the resonators 114-1 to 114-4, in the example of FIGS. 8A and 8B.

On the other hand, the delay circuit 118 uses a microstrip line of half-wavelength. The delay circuit 118 enables making about 180 phase difference between the signals passing the resonators 14-1, 14-3 having resonance frequencies f1, f3 in the output side of the power combiner 16 and the signals passing the resonators 14-2, 14-4 having the resonance frequencies f2, f4.

SECOND CONCRETE EXAMPLE

Figure 9:
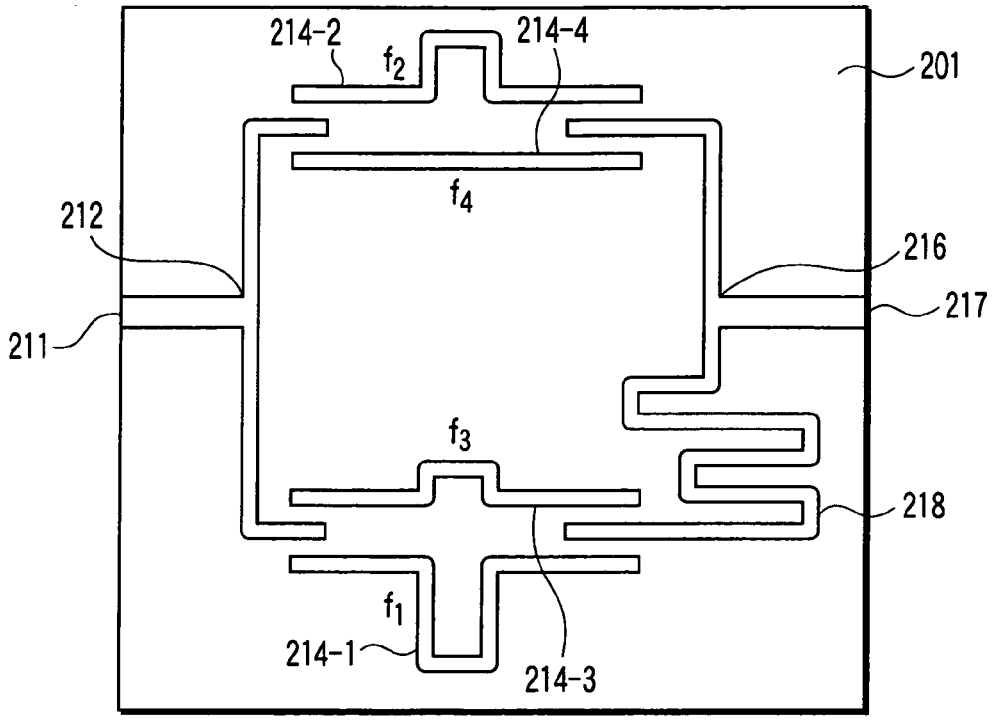
FIG. 9 shows a plan view of a second concrete unit of the filter circuit concerning the second embodiment.
Figure 10:
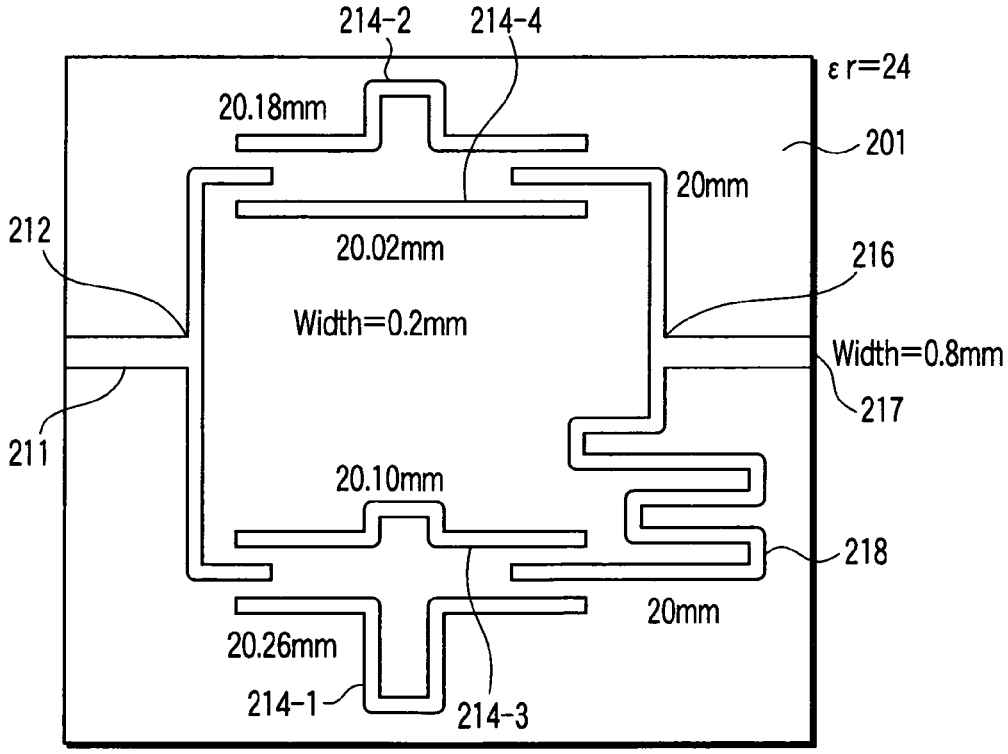
FIG. 10 is a diagram showing a concrete size of each part of the filter circuit of FIG. 9.

In the filter circuit concerning the second concrete example as shown in FIG. 9, a dielectric substrate 201, a signal input terminal 211, an power divider 212, input couplers, resonators 214-1 to 214-4 each fabricated by a half-wavelength type resonator, output couplers, a power combiner 216 and a signal output terminal 217 are similar to those of the first concrete example shown in FIG. 8. A point using a meander line for the output delay circuit 218 differs from the first concrete example. FIG. 10 shows a concrete dimension example of each part of FIG. 9.

THIRD CONCRETE EXAMPLE

Figure 11:
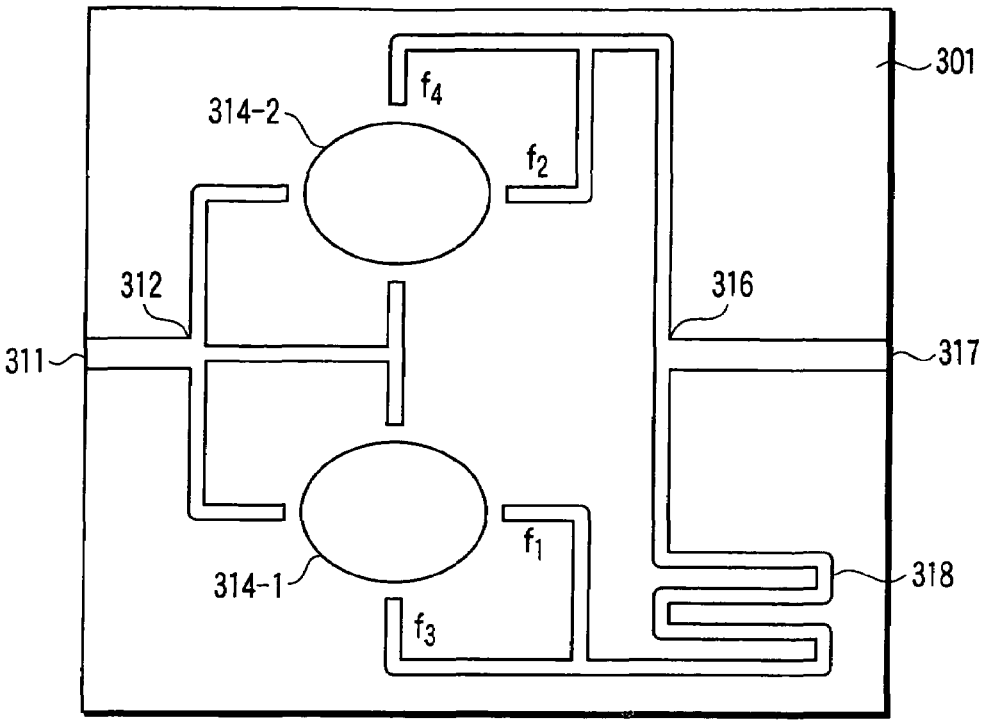
FIG. 11 shows a plan view of a third concrete unit of the filter circuit concerning the second embodiment.

In the filter circuit concerning the third concrete example as shown in FIG. 11, a dielectric substrate 301, a signal input terminal 311, an power divider 312, input couplers, output couplers, a power combiner 316, a signal output terminal 317, and an output delay circuit 318 formed by a meander line are fundamentally similar to those of the second concrete example shown in FIG. 9. A point using elliptic type resonators 314-1, 314-2 differs from the first and second concrete examples. The elliptic type resonator can realize two resonance frequencies with one resonator, so that a resonator unit having four resonance frequencies f1, f3, f2 and f4 can be realized by using two elliptic type resonators 314-1, 314-2 different in size from each other as shown in FIG. 11.

FOURTH CONCRETE EXAMPLE

Figure 12:
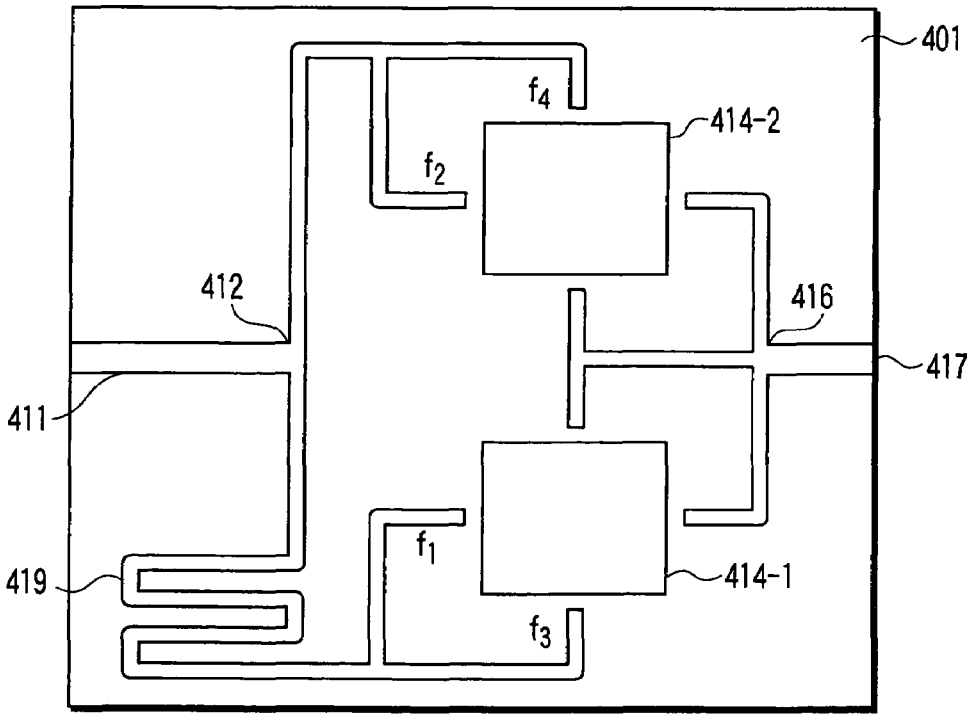
FIG. 12 shows a plan view of a fourth concrete unit of the filter circuit concerning the second embodiment.

In the filter circuit concerning the fourth concrete example shown in FIG. 12, a dielectric substrate 401, a signal input terminal 411, an power divider 412, input couplers, output couplers, a power combiner 416 and a signal output terminal 417 are fundamentally similar to those of the third concrete example shown in FIG. 11, A point using rectangular resonators 414-1, 414-2 instead of an elliptic type resonator differs from the third concrete example. The rectangular resonator can realize two resonance frequencies with one resonator similarly to an elliptic type resonator, so that a resonator unit having four resonance frequencies f1, f3, f2 and f4 can be realized by using two rectangular type resonators 414-1, 414-2 different in size from each other as shown in FIG. 12.

An output delay circuitry is provided in the first to third concrete examples, while the concrete example of FIG. 12 provides with an input delay circuit 419. In this concrete example, the input delay circuitry 419 is formed of a meander line, but it may use a linear microstrip line similar to that of the first concrete example.

The first to third concrete examples provide a filter circuit using a microstrip line. However, a filter circuit using a coplanar line or another transmission line can be realized. A filter circuit using a quarter-wavelength resonator instead of a half-wavelength resonator can be realized.

Figure 13:
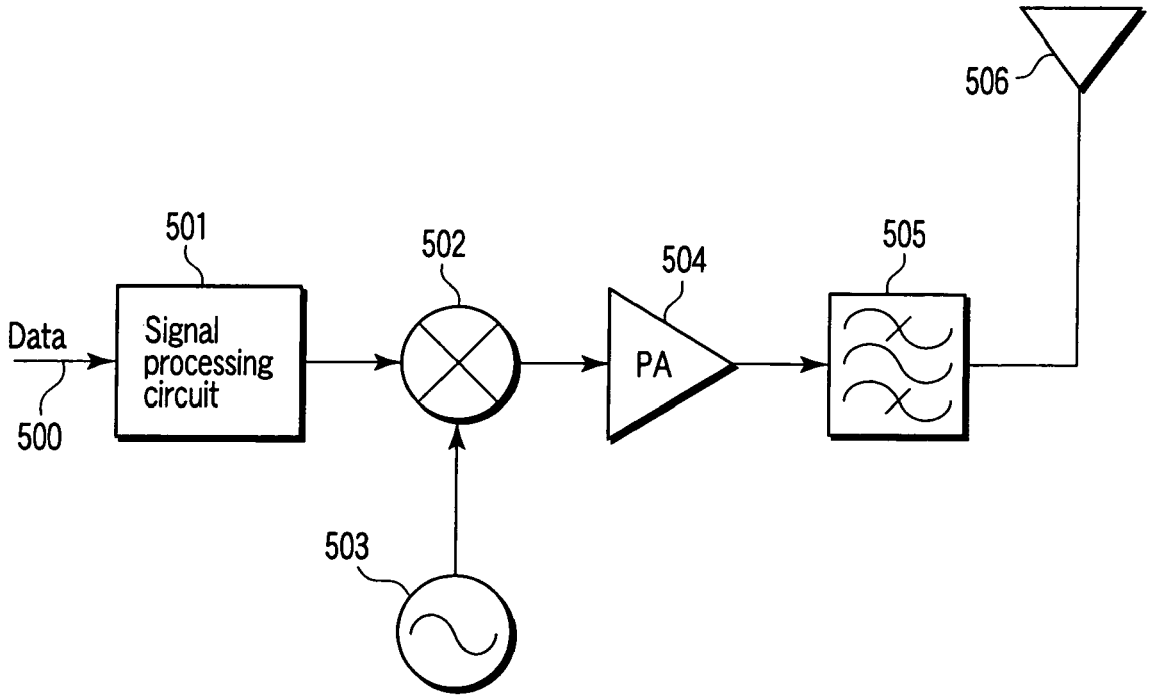
FIG. 13 is a block diagram of a transmitter of a radio communication apparatus using the filter circuit according to the embodiment of the present invention.

An example applying the filter circuit to a radio communication apparatus will be described referring to FIG. 13. FIG. 13 illustrates schematically a transmitter of a radio communication apparatus. Data 500 to be transmitted is input to a digital processing circuit 501 and subjected to processing such as digital-to-analog converting, encoding and modulating to generate a transmission signal of a baseband or an IF (Intermediate Frequency) band. The transmission signal from the digital disposal circuit 501 is input to a frequency converter (a mixer) 502, and multiplied with a local signal from a local signal generator 503 to be frequency-converted into a signal of RF (Radio Frequency) band, that is, up-converted.

The RF signal is amplified with a power amplifier 504 and then input to a band-pass filter (say a sending filter) 505. The RF signal is subjected to band limiting by this filter 505 to remove an unnecessary frequency component, and then supplied to a radio antenna 506. The filter circuit described in the above embodiments can be applied to the band-pass filter 505.

In the filter circuit concerning the embodiment of the present invention, because deviation between loaded Qs of a plurality of resonators to which an input signal is divided is equal to allowable deviation of a group delay, a group delay frequency characteristic can be flatted.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A filter circuit comprising:

a plurality of resonators connected in parallel and each having loaded Q deviation equal to allowable deviation of a group delay, the resonators each having a resonance frequency difference Δfi=fi+1−fi not more than 2*BW/(k-1). where i is a natural number not more than k-1, fi and fi+1 are the adjacent resonance frequencies, BW is a bandwidth of the filter circuit, and k is the number of resonators not less than 4;

a divider to divide an input signal to the resonators; and a combiner to combine output signals of the resonators, two resonators of the resonators having resonance frequencies adjacent to each other, the two resonators being arranged to make signals passing the two resonators an approximately opposite phase.

2. The filter circuit according to claim 1, wherein the resonators have input and output coupling coefficients equal to one another.

3. The filter circuit according to claim 1, wherein the opposite phase means includes means for setting one of input and output coupling coefficients of the two resonators to a first polarity and remaining ones of the input and output coupling coefficients to a second polarity of a reverse polarity with respect to the first polarity.

4. The filter circuit according to claim 1, wherein a coupling coefficient between one of the two resonators and the combiner and a coupling coefficient between the other of the two resonators and the combiner differ in polarity to each other.

5. The filter circuit according to claim 4, wherein the resonators have input and output coupling coefficients equal to one another.

6. The filter circuit according to claim 4, wherein one of input and output coupling coefficients of the two resonators has a first polarity and remaining ones of the input and output coupling coefficients each have a second polarity of a reverse polarity with respect to the first polarity.

7. The filter circuit according to claim 1, wherein a coupling coefficient between one of the two resonators and the divider and a coupling coefficient between the other of the two resonators and the divider differ in polarity to each other.

8. The filter circuit according to claim 7, wherein the resonators have input and output coupling coefficients equal to one another.

9. The filter circuit according to claim 7, wherein one of input and output coupling coefficients of the two resonators has a first polarity and remaining ones of the input and output coupling coefficients each have a second polarity of a reverse polarity with respect to the first polarity.

10. A filter circuit comprising:

a plurality of resonators connected in parallel and having loaded Q deviation equal to allowable deviation of a group delay, the resonators each having a resonance frequency difference Δfi=fi+1−fi (i is a natural number not more than k-1, and fi and fi+1 are the adjacent resonance frequencies) not more than 2*BW/(k-1) (BW is a bandwidth of the filter circuit, and k is number of the resonators not less than 4);

a divider to divide an input signal to the resonators;

a combiner to combine output signals of the resonators; and a delay circuit provided between at least one of the resonators and the combiner to make signals passing two resonators of the resonators an approximately opposite phase, the two resonators having two adjacent resonance frequencies respectively.

11. The filter circuit according to claim 10, wherein the resonators have input and output coupling coefficients equal to one another.

12. A filter circuit comprising:

a plurality of resonators connected in parallel and having loaded Q deviation equal to allowable deviation of a group delay, the resonators each having a resonance frequency difference Δfi=fi+1−fi (i is a natural number not more than k-1, and fi and fi+1 are the adjacent resonance frequencies) not more than 2*BW/(k-1) (BW is a bandwidth of the filter circuit, and k is number of the resonators not less than 4);

a divider to divide an input signal to the resonators; and a combiner to combine output signals of the resonators, a delay circuit provided between the divider and at least one of the resonators to make signals passing two resonators of the resonators an approximately opposite phase, the two resonators having two adjacent resonance frequencies respectively.

13. The filter circuit according to claim 12, which further comprises a plurality of input couplers having identical layouts and coupling the divider and each of the resonators and a plurality of output couplers having identical layouts and coupling each of the resonators and the combiner.

14. The filter circuit according to claim 12, wherein the resonators have input and output coupling coefficients equal to one another.

15. A radio communication apparatus comprising:

a power amplifier to amplify a high frequency signal;

the filter circuit of claim 1 which has an input terminal connected to an output terminal of the power amplifier; and a radio antenna connected to an output terminal of the filter circuit.

16. A radio communication apparatus comprising:

a power amplifier to amplify a high frequency signal;

the filter circuit of claim 10 which has an input terminal connected to an output terminal of the power amplifier; and a radio antenna connected to an output terminal of the filter circuit.

17. A radio communication apparatus comprising:

a power amplifier to amplify a high frequency signal;

the filter circuit of claim 12 which has an input terminal connected to an output terminal of the power amplifier; and a radio antenna connected to an output terminal of the filter circuit.

* * * * *